United States Patent [19]

Radford et al.

[11] Patent Number: 4,716,974

[45] Date of Patent: Jan. 5, 1988

[54] METHOD AND APPARATUS FOR CORING WITH AN IN SITU CORE BARREL SPONGE

[75] Inventors: Steven R. Radford, West Jordan; J. Stanley Davis, Sandy, both of Utah

[73] Assignee: Eastman Christensen Co, Salt Lake City, Utah

[21] Appl. No.: 887,352

[22] Filed: Jul. 21, 1986

[51] Int. Cl.[4] ..... E21B 25/06

[52] U.S. Cl. ..... 175/59; 175/65

[58] Field of Search ..... 175/58, 59, 65, 70, 175/72

[56] References Cited

U.S. PATENT DOCUMENTS 4,479,557 10/1984 Park et al. ..... 175/59

4,598,777 7/1986 Park et al. ..... 175/58

*Primary Examiner*—George A. Suchfield

*Attorney, Agent, or Firm*—Beehler, Pavitt, Siegemund, Jagger, Martella & Dawes

[57] ABSTRACT

Jamming caused by absorbent members in sponge core barrels or loss of coring information caused by oil wipes in oil field boreholes in which sponge core coring tools are disposed can be avoided by employing a method and tool wherein the absorbent member is formed in placed in contact about the core after the has been cut and disposed within the inner tube. In the illustrated embodiment, a liquid foam is catalytically formed from two constituent parts. The constituent parts are hydraulically forced from longitudinal chambers defined within the inner tube walls into an area in the throat of the bit where the parts meet and exothermically generate a liquid foam. The liquid foam rises into a plurality of longitudinal open chambers defined within the inner tube. Each of the open chambers has a longitudinal slot defined therethrough which communicates the chamber with the axial bore in which the core is disposed. The liquid foam flows into the longitudinal chambers and into the annular space between the inside surface of the inner tube and the core. Ultimately, the core is totally immersed in the liquid foam. Thereafter, within a predetermined curing time, the liquid foam cures to form a sponge-like solid. The oil bearing core may not be retrieved to the well surface. As the core is depressurized during retrieval, oil forced from the core by escaping water and gas is retained within the sponge for later analysis.

20 Claims, 4 Drawing Figures

Fig. 1
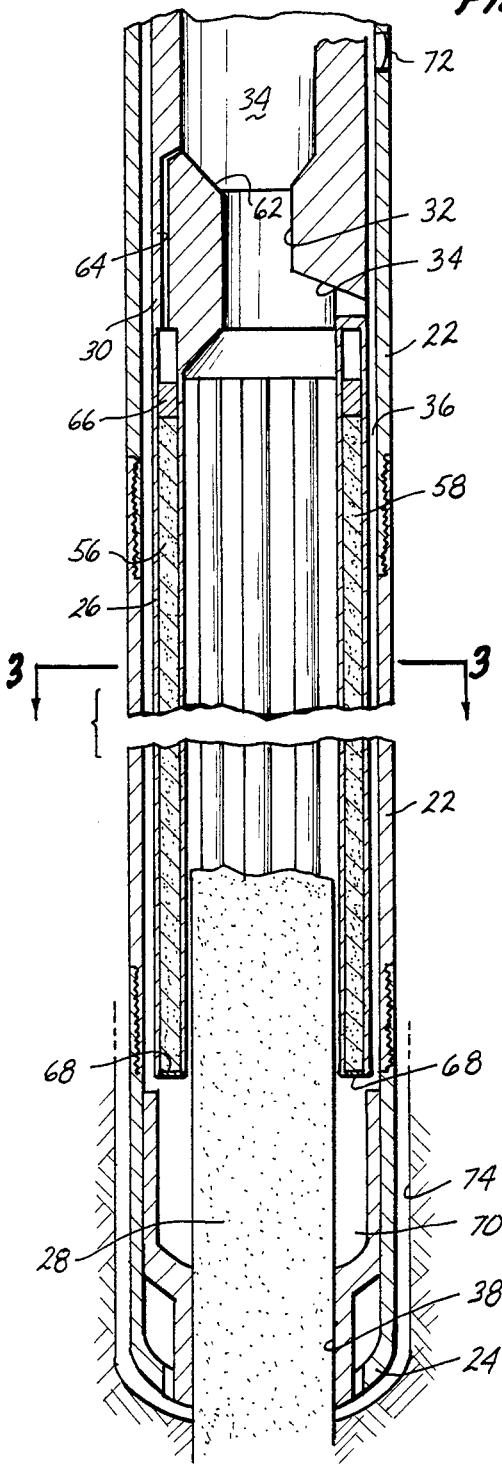
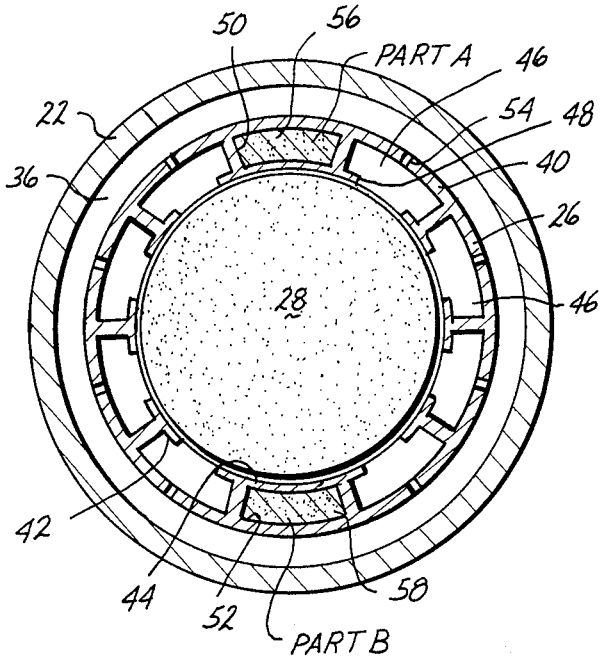
Fig. 3

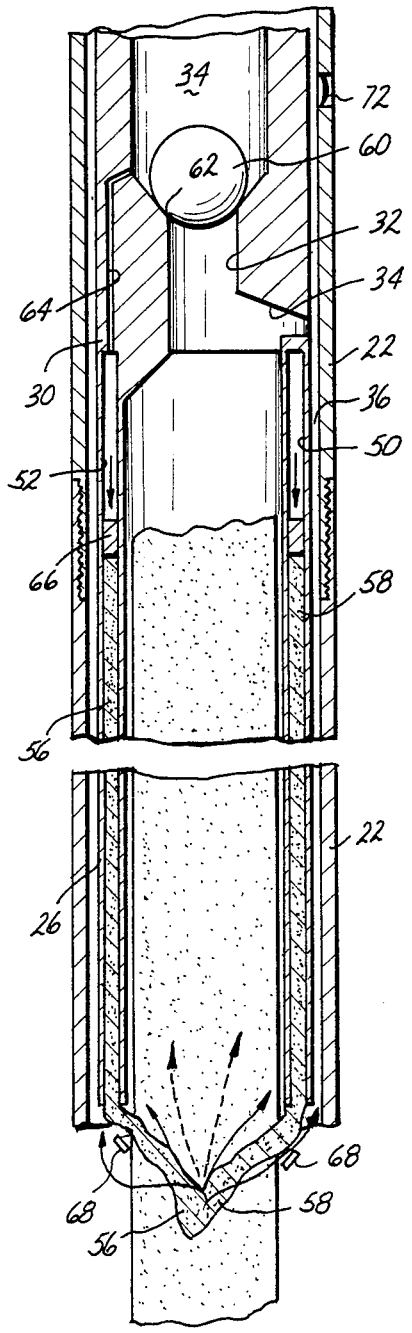
Fig. 2
Fig. 4
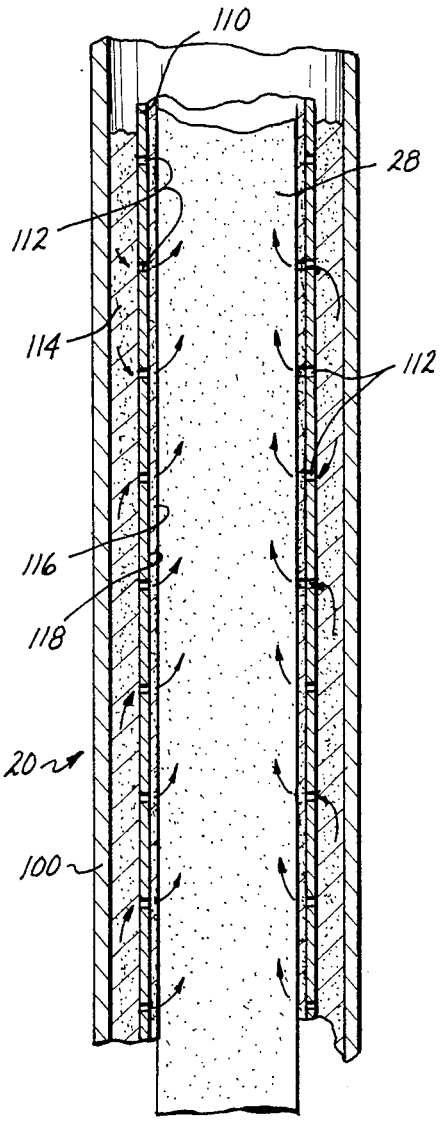

METHOD AND APPARATUS FOR CORING WITH AN IN SITU CORE BARREL SPONGE

BACKGROUND OF THE INVENTION

1. Field of the Invention

The invention relates to the field of earth boring or coring methodologies and in particular to coring methodologies in the petroleum arts where a sponge jacket is disposed about the cut core.

2. Description of the Prior Art

The loss or migration of fluids, oil or gases from cores cut from deep rock formation is well known and a number of technologies have been developed in order to prevent the loss or migration of such fluids. An alternation of the distribution of fluids in the cut core from that which exists within the core when cut, necessarily involves a material loss of information pertaining to the nature of the fluid or mineral deposition in the rock formation.

One of the prior art technologies which have been developed to preserve the deposition of fluids in cut cores is known as pressure coring. In pressure coring technology, the coring tool includes a means for maintaining the cut core under the same or substantially the same pressure which was exerted on the core when downhole. When the pressurized core is thus retrieved to the well surface, the pressure on the core is maintained and the core is taken to the laboratory where it can be analyzed and depressurized under controlled circumstances.

Another prior art technology for dealing with fluid loss or migration in cut cores is known as sponge coring. In a typical sponge coring tool, an absorbent sponge or foam material is disposed about the cut core such that fluids, which are forced out of the core as the core is depressurized while being tripped, are absorbed in adjacent layers of the cylindrical sponge sleeve. Loss or migration of the fluid or oil in the sponge sleeve is reduced or substantially avoided, thereby permitting additional analysis of the distribution of fluid within the core downhole.

However, sponge coring is susceptible to a number of substantial operational problems. Firstly, the sponge sleeve must be in close or tight contact with the core. This requirement can often be difficult to achieve in broken or unconsolidated cores. Even in the case where the core is hard and consolidated, the necessity of a tight fit between the sponge sleeve and the core can often result in jamming within the coring tool during the coring operation. Secondly, during drilling operations, oil may occur or pool in upper regions or on top of the core. As the core is then disposed within the sponge sleeve, the pooled oil is then deposited in the sponge along the entire length of the core as the core enters the barrel. This is referred to here as oil wipe. Clearly, in such cases, the oil deposition in the sponge sleeve is totally erroneous and masks all information which might otherwise be obtained from the core.

What is needed then is an apparatus and methodology which will permit the practice of sponge coring without susceptibility to jamming or oil wipe characteristic of the prior art.

BRIEF SUMMARY OF THE INVENTION

The invention is a method for recovering of subterranean fluid comprising the steps of cutting a core, disposing the core within an inner tube without the presence of any absorbent material in contact with the core, generating a foam in liquid form, disposing the foam in liquid form into contact with the core, curing the liquid foam to create a sponge-like solid in contact with the core disposed within the inner tube, and retrieving the inner tube, sponge-like solid and core to the well surface. As a result a substerraean core is taken, retrieved to the well surface, and depressurized during such retrieval, and the subterranean fluid contained within the core is retained within the sponge-like solid in the proximity of the core from which the subterranean fluid originated.

The step of generating the foam in liquid form comprises the steps of bringing into contact at least two constituent portions of the foam and creating the liquid foam from the constituent portions downhole after the core has been taken and while the core is in place in the inner tube.

The step of disposing the foam into contact with the core comprises the step of flowing the liquid foam around an annular space defined between the inner diameter of the inner tube and the exterior surface of the core. The liquid foam flows longitudinal upward within the annular space from the lowermost end of the inner tube.

The step of generating the foam in the liquid form comprises the steps of forcing at least two constituent parts of the foam from longitudinal chambers defined within the inner tube through openings provided in the longitudinal chambers at the lower most portion of the inner tube, and bringing the at least two constituent parts of the foam into contact in the vicinity of the lowermost portion of the inner tube to catalytically generate the liquid foam. The step of disposing the liquid foam into contact with the core comprises the steps of flowing the liquid foam longitudinally upward within a plurality of longitudinally disposed chambers defined within the inner tube. Each chamber has an aperture defined in an inner wall thereof communicating the chamber with an axial longitudinal bore defined in the inner tube in which bore the core has been disposed. The foam flows through the longitudinal chambers defined in the inner tube through the aperture of each chamber and in an annular space between the inner wall of the inner tube and the core.

The step of forcing the at least two constituent parts from the longitudinally chambers defined within the inner tube comprises the step of hydraulically forcing the at least two constituent parts from the corresponding longitudinal chambers by diverting hydraulic pressure from a normal flow path within coring tool to a piston disposed within each of the longitudinal chambers.

The step of disposing the liquid foam into contact with the core comprises the step of flowing the liquid into an annular space defined between an outer tube and an inner tube within the coring tool. The inner tube has a plurality of apertures defined therethrough in communication with the annular space. The liquid foam flows within the annular space through the plurality of apertures in the inner tube into another annular space defined between the inside surface of the inner tube and the core. The liquid foam fills the annular space between the inner tube and core.

The invention is also characterized as an apparatus for recovery of subterranean fluids comprising a mechanism for cutting a core containing the subterranean fluids, an inner tube for receiving the core associated with the mechanism for cutting, and a mechanism for forming an absorbent member about the core after the core has been cut and disposed in the inner tube. As a result the absorbent member absorbs and stores the subterranean fluid for later retrieval after the core has been cut. The absorbent member is not present within the inner tube when the core is disposed within the inner tube.

The mechanism for forming the absorbent member comprises mechanism which is in contact with the core. The mechanism for forming the absorbent member, in fact, forms the member from at least two constituent parts. The mechanism for forming the absorbent member forms a liquid foam, and disposes the liquid foam about the core. The liquid foam catalytically cures to form a sponge-like solid.

The inner tube comprises a cylindrical tube having an axial longitudinal chamber for receiving the core. The mechanism for forming the absorbent member about the core comprises at least two longitudinal chambers defined within the inner tube and a plurality of hollow longitudinal chambers defined within the inner tube for distributing the liquid foam within the inner tube. The longitudinal chambers for distributing the liquid foam each includes an aperture for communicating the liquid foam from the chamber into an annular space defined between the core and inner surface of the inner tube defining the axial bore.

The mechanism for forming the absorbent member comprises the at least two constituent parts of the absorbent member in at least two longitudinal chambers defined in the inner tube. Each chamber is provided with a slidable piston and mechanism for hydraulically forcing the piston longitudinally through the length of the constituent filled chamber. Each constituent chamber has a selectively opened output port through which the corresponding constituent part of the absorbent member flows. The two constituent parts of the absorbent member combine in the vicinity of the output ports to form the absorbent member.

The mechanism for forming the absorbent member comprises a mechanism for disposing a liquid foam in an annular space between the inner tube and outer tube. The inner tube is characterized by a plurality of aperatures therethrough. The plurality of apertures communicate the annular space between the outer and inner tubes with the axial bore defined within the inner tube. The liquid foam is disposed into the annular space through the apertures into the axial bore and into contact with the core. The liquid foam thereafter catalytically cures to form a sponge-like solid.

The invention can still further be characterized as a method for recovery of a subterranean fluid contained within a subterranean core comprising the steps of disposing the core within an inner tube. The inner tube defines an annular space about the core. Next an absorbent member is disposed in the annular space between the mechanism and core. As a result the subterranean fluid is trapped within the absorbent member as it migrates from the core, and the core is disposed into the inner tube without interference from the absorbent member.

The step of disposing an absorbent member in the annular space comprises the steps of first forming a liquid foam after the core has been disposed into the inner tube, and then flowing the liquid foam into the annular space and curing the liquid foam to form a sponge-like solid in contact with the core.

The step of flowing the liquid foam comprises the step of distributing the liquid foam in a plurality of longitudinal chambers radially exterior to the annular space, and communicating the liquid foam disposed in the longitudinally disposed apertures defined in the chambers.

The step of flowing the liquid foam into the annular space comprises the steps of flowing the liquid foam into an annular space defined between an outer tube concentrically disposed about the inner tube and flowing the liquid foam through a plurality of apertures through the inner tube. Each aperture communicates from the annular space between the outer and inner tubes to the annular space within the inner tube defined between inner tube and the core.

BRIEF DESCRIPTION OF THE DRAWINGS

FIG. 1 is a diagrammatic cross-sectional view of the lower portion of a drill string incorporated in the invention.

FIG. 2 is the cross-sectional view of FIG. 1 wherein the two constituent parts are activated to produce foam around a core.

FIG. 3 is a cross-sectional view of the tool shown in FIG. 1 taken through lines 3—3 of FIG. 1.

FIG. 4 is a diagrammatic cross-sectional view of a second embodiment of the invention wherein the means for storage and activation of the foam have been omitted for the sake of clarity.

The invention and its various embodiments may be better understood by now turning to the following detailed description.

DETAILED DESCRIPTION OF THE PREFERRED EMBODIMENTS

Jamming caused by absorbent members in sponge core barrels or loss of coring information caused by oil wipes in oil field boreholes in which sponge core coring tools are disposed can be avoided by employing a method and tool wherein the absorbent member is formed in place in contact about the core after the core has been cut and disposed within the inner tube. In the illustrated embodiment, a liquid foam is catalytically formed from two constituent parts. The constituent parts are hydraulically forced from longitudinal chambers defined within the inner tube walls into an area in the throat of the bit where the parts meet and exothermically generate a liquid foam. The liquid foam rises into a plurality of longitudinal open chambers defined within the inner tube. Each of the open chambers has a longitudinal slot defined therethrough which communicates the hamber with the axial bore in which the core is disposed. The liquid foam flows into the longitudinal chambers and into the annular space between the inside surface of the inner tube and the core. Ultimately, the core is totally immersed in the liquid foam. Thereafter, within a predetermined curing time, the liquid foam cures to form a sponge-like solid. The oil bearing core may now be retrieved to the well surface. As the core is depressurized during retrieval, oil forced from the core by escaping water and gas is retained within the sponge for later analysis.

The invention can also be described as follows. After a core is cut in a conventional manner and disposed within an inner tube, a multiple part foam is activated and is hydraulically forced into the annular space between the core and inner tube. The inner tube has a plurality of chambers defined longitudinally therethrough which permit the foam to ooze or flow upwardly within the inner tube. Each chamber includes a corresponding longitudinal slot which permits the foam to freely flow between annular space between the core and the inside surface of the inner tube as well as within the longitudinal chambers defined within the inner tube. Within a predetermined time period, the flowing material cures to form a sponge-like solid. The cut core is now encased in a cylindrical sponge sheath. As the core is brought to the well surface, oil migrating from the core is taken up within the sponge sheath and isolated. Since the foam material is not present while core is being cut, prior art difficulty caused by jamming between the sponge and core or any oil wipe, which might otherwise have occurred in conventional sponge sleeves in an oil field, does not occur in the sponge coring tool of the invention.

The invention can be better understood by turning to the diagrammatic cross-sectional illustration of FIG. 1 showing a simplified form of a coring tool incorporating the invention. This embodiment in no way limits the invention since any number of individual designs may incorporate the theories and claims of the invention. Coring tool 20 is comprised of an outer tube 22 and coring bit 24 which is diagrammatically depicted. Outer tube 22 is coupled to coring bit 24 through a conventional thread connection. Rotary motion from the well surface is imparted by outer tube 22 to bit 24. Concentrically disposed within outer tube 22 is an inner tube 26, which in the present invention holds the constituent portions for the sponge to be formed. Typically, inner tube 26 is coupled within the drill string to a bearing assembly (not shown) so that inner tube 26 remains rotationally stationary as outer tube 22 and bit 24 rotate. Inner tube 26 is provided with an inner tube cap 30 which is diagrammatically depicted in highly simplified form. Inner tube cap 30 is coupled to inner tube 26 at one end and on at the other end is coupled to internal structures within the drill string, such as a conventional bearing assembly. Inner tube cap 30 is characterized by a central axial bore 32. Axial bore 32 is provided with a flow of drilling mud by conventional means from a superior internal chamber 34 within tool 20. Once the core begins to enter tube 26, inner tube 26 will be substantially blocked. Drilling mud will then be diverted through a plurality of diversion ports 34 defined in inner tube cap 30, one of which diversion ports 34 is depicted in FIGS. 1 and 2. The hydraulic mud is thus supplied to the annular space 36 between the outer diameter of inner tube 26 and the inner diameter of outer tube 22. Drilling mud continues to longitudinally flow downward within tool 20 and continues to be supplied to the inner gage 38 or other internal hydraulic conduits (not shown) which are conventional within the design of coring bit 24.

Before considering the operation of coring tool 20, turn now to the cross-sectional illustration of FIG. 3, taken through line 3—3 of FIG. 1, showing inner tube 26 in enlarged scale. Inner tube 26, which may be fabricated from extruded aluminum, is a generally cylindrical tube having an outer cylindrical wall 40 with a plurality of inwardly radially extending ribs 42. Inner tube 26 further comprises an inner wall 44 contiguous with ribs 42 to form a plurality of longitudinally chambers 46. Inner wall 44 is opened at or near a mid longitudinal line in most of the chambers 46 to define a longitudinal slot 48. Two diametrically opposing chambers 50 and 52 are provided in which no longitudinal slot 48 is defined in inner wall 44. Thus, both chambers 50 and 52 form closed longitudinal chambers through the length of inner tube 26. Each of the open chambers 46 are similarly provided with radially defined bleed holes 54 defined through outer wall 40 along the longitudinal length of chambers 46.

As will be described below, a foam creating material is formed from two constituents which are here generically labeled as a part A, generally denoted by reference numeral 56 and part B, generally denoted by reference numeral 58. In the illustrated embodiment, the foam is a high performance elastomeric which is foamed with water, a surfactant and catalytics. Such foam materials are well known to the art and are manufactured by numerous companies such as Uniroyal, American Cyanamide and others. The foam that is formed variously forms opened or closed cells with varying densities. Typically, the foamed elastomeric is formed from two liquid components to generate a sponge foam having a closed cell content of approximately 40% and an opened cell content of approximately 60%. The percentage of closed or opened content can be varied by varying the formulation of constituent materials according to well known principles. The density of the resulting foam, which is 40% closed and 60% open, is approximately 8 pounds per cubic foot. Again, density can be manipulated according to well understood principles as well as cell structure to obtain such liquid and gas retention properties within the foam as desired.

Microporous foams are well known and can similarly be fabricated from two constituents that will retain heavier materials such as oil, but which will be subtantially porous to lighter liquids and gases, such as water and natural gases. The chemical and physical properties of the foam as well as the details of its formation are incidental to the invention and will not further be described here beyond the extent necessary to understand the creation and the flow of the foam within the tool.

Turn now to FIG. 2 which is a cross-sectional illustration of the tool shown in Figure after a predetermined length of core 28 has been cut and drop ball 60 disposed within tool 20. Drop ball 60, as is well known in the art, moves downwardly with the hydraulic mud and ultimately comes to rest against valve seat 62 of orifice 32. At this point further flow of drilling mud through orifice 32 as prohibited and the pressure above inner tube cap 30 increases. The increased pressure is communicated through a duct defined in inner tube cap 30 which communicates at one end with axial chamber 34 and at the other end with the top of inner tube 26. The increased pressure from hydraulic fluid is communicated to chambers 50 and 52. Chambers 50 and 52 are each provided with a slidable piston 66. Hydraulic pressure is then evenly applied to piston 66 in both chambers 50 and 52 which then couples the increased hydraulic pressure to the underlying liquid foam constituents 56 or 58 as appropriate. Hydraulic pressure will continue to build until burst seals 68 at the opposing ends of chambers 50 and 52, which seals the lower ends of those chambers, fail or burst. Burst seals 68, which are well known to the art, burst at the same pressure thereby allowing the contained constituents 56 and 58 to flow from the ends of inner tube 26 into the throat 70 of core bit 24 and around core 28. The elastomeric constituents 56 and 58 are immiscible with the drilling mud. Any drilling mud present within the coring tube is displaced from throat 70. When part A, 56 meets part B, 58 within throat 70 an exothermic reaction occurs which creates a foam which is still in liquid form. The foaming liquid acts as an additional source of pressure within throat 70 and flows from the throat 70 in the direction of least resistance.

The lower ends of each of the chambers 46 of inner tube 26 are open and adjacent to the lower ends of what are now the burst chambers 50 and 52. The liquid foam rapidly expands upwardly within chambers 46 to displace the drilling mud which previously filled those chambers. As the expanding liquid foam fills chambers 46, it also flows within the annular space between core 28 and inner wall 44 of inner tube 26 and through slots 48. Drilling mud within inner tube 26, including chambers 46, is displaced therefrom and flows from the top of inner tube 26 and in part through the plurality of bleed holes 54. Outer tube 22 is similarly rovided with a burst disk 72 in its upper portion. When sufficient internal pressure within outer tube 22 is achieved through the formation of the foam, burst disk 72 ruptures permitting the escape of drilling mud into the annular space between the bore hole 74 and the exterior of outer tube 22.

Ultimately, the entire length of inner tube 26, including the inner spaces of chambers 46 and any annular space between core 28 and inside surface 44 of inner tube 26 will be completely filled with the liquid foam. Thereafter, within a predetermined time, such as one half to one hour, the liquid foam will set into a sponge-like solid which has in essence been cast about core 28.

Tool 20 can then be tripped in a conventional manner bringing core 28 to the surface. As core 28 is brought to the surface, it becomes depressurized and escaping water and gas is free to migrate through the sponge-like material surrounding core 28, into chambers 46 and through bleed holes 54. However, oil which is trapped within core 28 and forced outwardly during the depressurization of the core will remain trapped within the sponge-like solid. Upon disassembly, inner tube 26 can then be cut and shipped to laboratories with the core intact and all heavy fluids retained in a longitudinal proximity of the portion of core 28 from which the fluids exuded.

Turn now to FIG. 4 wherein an alternative embodiment is illustrated as shown in a simplified cross-sectional view. The coring tool, again generally designated by the reference character 20, is shown as comprised of an outer tube 100 and a perforated inner tube 110. Inner tube 110 includes a plurality of holes 112 communicating through the inner tube 110. As before, the cut core 28 is concentrically received within an axial bore defined by inner tube 110. In the embodiment of FIG. 4, that portion of coring tool 20 including the coring bit and means for holding and dispensing parts A and B the foam have not been shown. It is expressely contemplated that any means well known to the art could be included for storing, mixing and disposing the foam within coring tool 20. For example, closed containers disposed within a drill string above inner tube 110 or alternatively within outer tube 100 in the vicinity of the throat of the coring bit could be included for enclosing and separating part A and part B of the foam. Electrically operated solenoid valves could then be operated to selectively pressurize the two holding chambers for part A and part B and the two parts of the foam could be brought together through conduits to a common meeting place near the bottom of inner tube 110 in the vicinity of annular space 114. When part A and part B meet together in the throat of the bit, the liquid foam is generated and rapidly expands upwardly in annular space 114. The viscosity and pressure within the generated liquid foam is sufficient to drive the foam through holes 112 in inner tube 110 into the annular cylindrical space 116 between the inside surface 118 of inner tube 110 and core 28.

As in the embodiments of FIGS. 1–3, the foam is placed into immediate connect with core 28 and further is in communication with a concentrically surrounding layer of foam which fills annular space 114 between outer tube 100 and inner tube 110. As the core is brought to the well surface, water and gas can again migrate through the foam within the space 116, through hole 112 and into annular space 114 now filled with a set sponge-like solid. More dense liquids such as oil are trapped within sponge layer 116 immediately surrounding core 28 and to the extent that the absorption capacities of annular sponge layer 116 are exceeded, excess oils can be disposed through holes 112. The type and distribution of heavier fluids and oils within the core is nevertheless impregnated into and retained within the immediately contacting layer 116 of the sponge-like foam solid.

Inner tube 110 has an inner diameter somewhat in excess of the outer diameter of core 28. Therefore, little opportunity is provided for core 28 to jam within inner tube 110 particularly since there is no sponge layer in place within annular space 116 as the core is being taken. However, annular space 116 is of sufficient radial dimension to provide a sufficient thickness for the later-formed sponge layer to retain the desired fluids or oils for laboratory analysis. The radial dimension of annular space 116 can be adjusted as desired, according to well understood principles with respect to the dispersion of oils within sponge materials.

Many alterations and modifications may be made by those having ordinary skill in the art without departing from the spirit and scope of the invention. Therefore the illustrated embodiments have been set forth only by way of example and should not be taken as limiting the invention which is defined in the following claims.

We claim:

1. A method for recovering of subterranean fluid from a core at a well surface comprising the steps of:
   - cutting a core downhole under pressure;
   - disposing said core within an inner tube without the presence of any absorbent material in contact with said core;
   - generating a foam in liquid form downhole;
   - disposing said foam in liquid form into contact with said core downhole;
   - curing said liquid foam downhole to create a sponge-like solid in contact with said core disposed within said inner tube; and
   - retrieving said inner tube, sponge-like solid and core to the well surface,
   - whereby a subterranean core is taken, retrieved to the well surface, and depressurized during such retrieval, and wherein subterranean fluid contained within said core is retained within said sponge-like solid in the proximity of said core from which said subterranean fluid originated.

2. A method for recovering of subterranean fluid comprising the steps of:
   - cutting a core;

disposing said core within an inner tube without the presence of any absorbent material in contact with said core;

generating a foam in liquid form;

disposing said foam in liquid form into contact with said core;

curing said liquid foam to create a sponge-like solid in contact with said core disposed within said inner tube;

retrieving said inner tube, sponge-like solid and core to the well surface; and where said step of generating said foam in liquid form comprises the steps of bringing into contact at least two constituent portions of said foam and creating said liquid foam from said constituent portions downhole after said core has been taken and while said core is in place in said inner tube, whereby a subterranean core is taken, retrieved to the well surface, and depressurized during such retrieval, and wherein subterranean fluid contained within said core is retained within said sponge-like solid in the proximity of said core from which said subterranean fluid originated.

3. The method of claim 2 where said step of disposing said foam into contact with said core comprises the steps of:

flowing said liquid foam around an annular space defined between the inner diameter of said inner tube and the exterior surface of said core, said liquid foam flowing longitudinally upward within said annular space from the lowermost end of said inner tube.

4. A method for recovering of subterranean fluid comprising the steps of:

cutting a core;

disposing said core within an inner tube without the presence of any absorbent material in contact with said core;

generating a foam in liquid form;

disposing said foam in liquid form into contact with said core;

curing said liquid foam to create a sponge-like solid in contact with said core disposed within said inner tube; and retrieving said inner tube, sponge-like solid and core to the well surface, where said step of generating said foam in said liquid form comprises the steps of:

forcing at least two constituent parts of said foam from longitudinal chambers defined within said inner tube through openings provided in said longitudinal chambers at the lower most portion of said inner tube, and bringing said at least two constituent parts of said foam into contact in the vicinity of said lowermost portion of said inner tube to catalytically generate said liquid foam; and where said step of disposing said liquid foam into contact with said core comprises the steps of flowing said liquid foam longitudinally upward within a plurality of longitudinally disposed chambers defined within said inner tube, each chamber having an aperture defined in an inner wall thereof communicating said chamber with an axial longitudinal bore defined in said inner tube in which bore said core has been disposed, said foam flowing through said longitudinal chambers defined in said inner tube through said aperture of each chamber and in an annular space between said inner wall of said inner tube and said core, whereby a subterranean core is taken, retrieved to the well surface, and depressurized during such retrieval, and wherein subterranean fluid contained within said core is retained within said sponge-like solid in the proximity of said core from which said subterranean fluid originated.

5. The method of claim 3 where said step of generating said foam and said liquid form comprises the steps of:

forcing at least two constituent parts of said foam from longitudinal chambers defined within said inner tube through openings provided in said longitudinal chambers at the lowermost portion of said inner tube, and bringing said at least two constituent parts of said foam into contact in the vicinity of said lower most portion of said inner tube to catalytically generate said liquid foam; and where said step of disposing said liquid foam into contact with said core comprises the steps of flowing said liquid foam longitudinally upward within a plurality of longitudinally disposed chambers defined within said inner tube, each chamber having an aperture defined in an inner wall thereof communicating said chamber with an axial longitudinal bore defined in said inner tube in which bore said core has been disposed, said foam flowing through said longitudinal chambers defined in said inner tube through said aperture of each chamber and in an annular space between said inner wall of said inner tube and said core.

6. The method of claim 5 wherein said step of forcing said at least two constituent parts from said longitudinally chambers defined within said inner tube comprises the step of hydraulically forcing said at least two constituent parts from said corresponding longitudinal chambers by diverting hydraulic pressure from a normal flow path within coring tool to a piston disposed within each of said longitudinal chambers.

7. A method for recovering of subterranean fluid comprising the steps of:

cutting a core;

disposing said core within an inner tube without the presence of any absorbent material in contact with said core;

generating a foam in liquid form;

disposing said foam in liquid form into contact with said core;

curing said liquid foam to create a sponge-like solid in contact with said core disposed within said inner tube; and retrieving said inner tube, sponge-like solid and core to the well surface; and where said step of disposing said liquid foam into contact with said core comprises the step of flowing said liquid into an annular space defined between an outer tube and an inner tube within said coring tool, said inner tube having a plurality of apertures defined therethrough in communication with said annular space, and flowing said liquid foam within said annular space through said plurality of apertures in said inner tube into another annular space defined between the inside surface of said inner tube and said core, said liquid foam filling said annular space between said inner tube and core, whereby a subterranean core is taken, retrieved to the well surface, and depressurized during such retrieval, and wherein subterranean fluid contained within said core is retained within said sponge-like solid in the proximity of said core from which said subterranean fluid originated.

8. An apparatus for recovery of subterranean fluids at a well surface comprising:

means for cutting a core downhole containing said subterranean fluids;

inner tube means associated with said means for cutting, said inner tube means for receiving said core downhole; and means for forming an absorbent member about said core downhole after said core has been cut and disposed in said inner tube means, whereby said absorbent member absorbs and stores said subterranean fluid for later retrieval at said well surface after said core has been cut, and whereby said absorbent member is not present within said inner tube when said core is disposed within said inner tube means.

9. An apparatus for recovery of subterranean fluids comprising:

means for cutting a core containing said subterranean fluids;

inner tube means associated with said means for cutting, said inner tube means for receiving said core; and means for forming an absorbent member about said core after said core has been cut and disposed in said inner tube means; and wherein said means for forming said absorbent member comprises means for forming said absorbent member in contact with said core, whereby said absorbent member absorbs and stores said subterranean fluid for later retrieval after said core has been cut, and whereby said absorbent member is not present within said inner tube when said core is disposed within said inner tube means.

10. The apparatus of claim 9 wherein said means for forming said absorbent member form said absorbent member from at least two constituent parts.

11. The apparatus of claim 10 wherein said means for forming said absorbent member forms a liquid foam, and disposes said liquid foam about said core, said liquid foam catalytically curing to form a sponge-like solid.

12. The apparatus of claim 11 wherein said inner tube means comprises a cylindrical tube having an axial longitudinal chamber for receiving said core and wherein said means for forming said absorbent member about said core comprises at least two longitudinal chambers defined within said inner tube and a plurality of hollow longitudinal chambers defined within said inner tube for distributing said liquid foam within said inner tube, said longitudinal chambers for distributing said liquid foam each including an aperture for communicating said liquid foam from said chamber into an annular space defined between said core and inner surface of said inner tube defining said axial bore.

13. An apparatus for recovery of subterranean fluids comprising:

means for cutting a core containing said subterranean fluids;

inner tube means associated with said means for cutting, said inner tube means for receiving said core;

means for forming an absorbent member about said core after said core has been cut and disposed in said inner tube means; and wherein said inner tube means comprises a cylindrical tube having an axial longitudinal chamber for receiving said core and wherein said means for forming said absorbent member about said core comprises at least two longitudinal chambers defined within said inner tube and a plurality of hollow longitudinal chambers defined within said inner tube for distributing said liquid foam within said inner tube, said longitudinal chambers for distributing said liquid foam each including an aperture for communicating said liquid foam from said chamber into an annular space defined between said core and inner surface of said inner tube defining said axial bore, whereby said absorbent member absorbs and stores said subterranean fluid for later retrieval after said core has been cut, and whereby said absorbent member is not present within said inner tube when said core is disposed within said inner tube means.

14. The apparatus of claim 12 wherein said means for forming said absorbent member comprises said at least two constituent parts of said absorbent member in at least two longitudinal chambers defined in said inner tube, each said chamber provided with a slidable piston and means for hydraulically forcing said piston longitudinally through the length of said constituent filled chamber, each constituent chamber having a selectively opened output port through which said corresponding constituent part of said absorbent member flows, said at least two constituent parts of said absorbent member combining in the vicinityh of said output ports to form said absorbent member.

15. The apparatus of claim 13 wherein said means for forming said absorbent member comprises said at least two constituent parts of said absorbent member in at least two longitudinal chambers defined in said inner tube, each said chamber provided with a slidable piston and means for hydraulically forcing said piston longitudinally through the length of said constituent filled chamber, each constituent chamber having a selectively opened output port through which said corresponding constituent part of said absorbent member flows, said at least two constituent parts of said absorbent member combining in the vicinity of said output ports to form said absorbent member.

16. An apparatus for recovery of subterranean fluids comprising:

means for cutting a core containing said subterranean fluids;

inner tube means associated with said means for cutting, said inner tube means for receiving said core;

means for forming an absorbent member about said core after said core has been cut and disposed in said inner tube means; and wherein said means for forming said absorbent member comprises:

means for disposing a liquid foam in an annular space between said inner tube and outer tube, said inner tube characterized by a plurality of apertures therethrough, said plurality of apertures communicating said annular space between said outer and inner tubes with said axial bore defined within said inner tube, said liquid foam being disposed into said annular space through said apertures into said axial bore and into contact with said core, said liquid foam thereafter catalytically curing to form a sponge-like solid, whereby said absorbent member absorbs and stores said subterranean fluid for later retrieval after said core has been cut, and whereby said absorbent member is not present within said inner tube when said core is disposed within said inner tube means.

17. A method for recovery at a well surface of a subterranean fluid contained within a subterranean core comprising the steps of:

disposing said core within an inner tube means downhole, said inner tube means for defining an annular space about said core; and disposing an absorbent member in said annular space between said means and core downhole, whereby said subterranean fluid is trapped within said absorbent member as it migrates from said core when said core is retrieved to said well surface, and whereby said core is disposed into said inner tube means downhole without interference from said absorbent member.

18. A method for recovery of a subterranean fluid contained within a subterranean core comprising the steps of:

disposing said core within an inner tube means, said inner tube means for defining an annular space about said core;

disposing an absorbent member in said annular space between said means and core; and where said step of disposing an absorbent member in said annular space comprises the steps of:

first forming a liquid foam after said core has been disposed into said inner tube means, flowing said liquid foam into said annular space and curing said liquid foam to form a sponge-like solid in contact with said core, whereby said subterranean fluid is trapped within said absorbent member as it migrates from said core, and whereby said core is disposed into said inner tube means without interference from said absorbent member.

19. The method of claim 18 where said step of flowing said liquid foam comprises the step of:

distributing said liquid foam in a plurality of longitudinal chambers radially exterior to said annular space, and communicating said liquid foam disposed in said longitudinal chambers into said annular space through longitudinally disposed apertures defined in said chambers.

20. The method of claim 18 where said step of flowing said liquid foam into said annular space comprises the steps of:

flowing said liquid foam into a annular space defined between an outer tube concentrically disposed about said inner tube means and flowing said liquid foam through a plurality of apertures through said inner tube means, each aperture communicating from said annular space between said outer and inner tubes to said annular space within said inner tube means defined between inner tube means and said core.

* * * * *